US011489293B2

(12) United States Patent
Balakrishnan et al.

(10) Patent No.: US 11,489,293 B2
(45) Date of Patent: Nov. 1, 2022

(54) RECEPTACLE MODULE AND RECEPTACLE CAGE FOR A COMMUNICATION SYSTEM

(71) Applicant: TE Connectivity Services GmbH, Schaffhausen (CH)

(72) Inventors: Nitish Balakrishnan, Harrisburg, PA (US); Michael John Phillips, Camp Hill, PA (US); Christopher David Ritter, Hummelstown, PA (US)

(73) Assignee: TE CONNECTIVITY SOLUTIONS GmbH, Schaffhausen (CH)

( * ) Notice: Subject to any disclaimer, the term of this patent is extended or adjusted under 35 U.S.C. 154(b) by 0 days.

(21) Appl. No.: 17/128,372

(22) Filed: Dec. 21, 2020

(65) Prior Publication Data

US 2022/0200210 A1 Jun. 23, 2022

(51) Int. Cl.
*H01R 13/659* (2011.01)
*H01R 12/72* (2011.01)
*H01R 13/627* (2006.01)

(52) U.S. Cl.
CPC ..... *H01R 13/659* (2013.01); *H01R 12/721* (2013.01); *H01R 13/6273* (2013.01)

(58) Field of Classification Search
CPC .. H01R 13/6582–6584; H01R 13/6596; H01R 13/6271; H01R 13/6335; H01R 13/6591; H01R 13/6691; H01R 2201/04; H01R 13/659; H01R 13/6273; H01R 12/721
USPC ..... 439/607.17–607.21, 607.28–607.3
See application file for complete search history.

(56) References Cited

U.S. PATENT DOCUMENTS

| | | | | |
|---|---|---|---|---|
| 6,739,759 | B1 * | 5/2004 | Seeley | G02B 6/3849 385/60 |
| 8,714,839 | B2 * | 5/2014 | Ito | H05K 9/0058 385/92 |
| 9,011,177 | B2 * | 4/2015 | Lloyd | H05K 3/222 439/607.47 |
| 9,705,258 | B2 * | 7/2017 | Phillips | H01R 13/74 |
| 10,114,182 | B2 * | 10/2018 | Zbinden | G02B 6/4268 |
| 10,476,198 | B1 * | 11/2019 | Pogash | H01R 13/518 |
| 10,873,160 | B2 * | 12/2020 | Henry | H01R 13/6586 |
| 10,873,161 | B2 * | 12/2020 | Henry | H01R 13/633 |
| 2014/0286613 | A1 * | 9/2014 | Ito | H05K 9/0058 385/88 |
| 2018/0212385 | A1 * | 7/2018 | Little | H01R 13/504 |
| 2019/0027882 | A1 * | 1/2019 | Wang | H01R 13/6591 |
| 2020/0274295 | A1 * | 8/2020 | Briant | G02B 6/4292 |
| 2020/0358227 | A1 * | 11/2020 | Henry | H01R 13/6586 |
| 2021/0051824 | A1 | 2/2021 | Decrock et al. | |
| 2021/0296818 | A1 * | 9/2021 | Briant | H01R 13/6691 |

* cited by examiner

*Primary Examiner* — Gary F Paumen

(57) ABSTRACT

A communication system includes a plug module and a receptacle module received in a receptacle cage. The receptacle module includes a receptacle housing having a cavity that receives a contact assembly. The receptacle module includes a receptacle latch coupled to the receptacle housing having latching features at sidewalls of the receptacle housing and receptacle release tabs operably coupled to a receptacle release actuator.

20 Claims, 5 Drawing Sheets

RECEPTACLE MODULE AND RECEPTACLE CAGE FOR A COMMUNICATION SYSTEM

BACKGROUND OF THE INVENTION

The subject matter herein relates generally to communication systems.

Some communication systems utilize transceivers or plug modules as I/O modules for data communication. The plug module is pluggably received in a receptacle cage of a receptacle assembly to interconnect the plug module with another component, such as a host circuit board through a communication connector mounted to the host circuit board. Due to the high speed of data transmission and the length of the traces on the host circuit board between the communication connector and other components mounted to the host circuit board, some known communication systems bypass data transmission on the host circuit board using a cable receptacle connector. The cable receptacle connector may be received in the rear end of the receptacle cage and the plug module is mated directly to the cable receptacle connector. However, the cable receptacle connector tends to be bulky and require mounting features for mounting the cable receptacle connector to the receptacle cage. The mounting features widen the connector interface and occupy space adjacent the receptacle cage, which increases the footprints of the receptacle cages and the cable receptacle connectors on the host circuit board and limits the number of receptacle cages and cable receptacle connectors that may fit within a particular area.

A need remains for a communication system having a reduced footprint for mating pluggable modules.

BRIEF DESCRIPTION OF THE INVENTION

In one embodiment, a communication system is provided. The communication system includes a plug module including a plug housing having plug housing walls defining a plug module cavity. The plug housing walls include a top wall, a bottom wall and sidewalls between the top wall and the bottom wall. The plug module includes a plug latch coupled to the plug housing. The plug latch includes plug latching features at the sidewalls of the plug housing and plug release tabs operably coupled to a plug release actuator. The plug module includes a plug module circuit board held by the plug housing in the plug module cavity. The plug module circuit board has a mating edge. The plug module includes cables terminated to the plug module circuit board. The communication system includes a receptacle module including a receptacle housing having receptacle housing walls defining a receptacle module cavity. The receptacle housing walls include a top wall, a bottom wall and sidewalls between the top wall and the bottom wall. The receptacle module includes a receptacle latch coupled to the receptacle housing. The receptacle latch includes receptacle latching features at the sidewalls of the receptacle housing and receptacle release tabs operably coupled to a receptacle release actuator. The receptacle module includes a receptacle contact assembly received in the receptacle housing. The receptacle contact assembly includes receptacle contacts. The receptacle housing has a card slot at a front of the receptacle housing receiving the mating edge of the plug module circuit board to electrically connect the receptacle contacts to the plug module circuit board. The receptacle module includes cables terminated to the receptacle contacts and extending rearward from the receptacle housing. The communication system includes a receptacle cage having cage walls defining a module channel. The module channel extends between a front end and a rear end of the receptacle cage. The cage walls include a top cage wall, a bottom cage wall, and side cage walls extending between the top cage wall and the bottom cage wall. The receptacle cage has a front cage interface receiving the plug module at the front end and the receptacle cage having a rear cage interface receiving the receptacle module at the rear end. The receptacle cage includes front latching features at the side cage walls interfacing with the plug latching features for latchably securing the plug module in the receptacle cage. The receptacle cage includes rear latching features at the side cage walls interfacing with the receptacle latching features for latchably securing the receptacle module in the receptacle cage.

In another embodiment, a communication system is provided. The communication system includes a receptacle cage having cage walls defining a module channel. The module channel extends between a front end and a rear end of the receptacle cage. The cage walls include a top cage wall, a bottom cage wall, a first side cage wall and a second side cage wall. The cage walls enclose the module channel between the front end and the rear end. The receptacle cage is configured to receive a plug module at the front end. The receptacle cage includes a first latching beam at a first side and a second latching beam at a second side of the receptacle cage. The communication system includes a receptacle module removably received in the module channel at the rear end. The receptacle module includes a receptacle housing having receptacle housing walls defining a receptacle module cavity. The receptacle housing walls include a top wall, a bottom wall a first side wall, and a second side wall. The first side wall includes a first latching feature configured to interface with the first latching beam of the receptacle cage to secure the receptacle module in the receptacle cage. The second side wall includes a second latching feature configured to interface with the second latching beam of the receptacle cage to secure the receptacle module in the receptacle cage. The receptacle housing has a card slot configured to receive a plug module circuit board of the plug module. The receptacle module includes a receptacle contact assembly received in the receptacle housing. The receptacle contact assembly includes receptacle contacts arranged in the receptacle housing at the card slot to interface with the plug module circuit board. The receptacle contact assembly includes cables terminated to the contacts and extends from the receptacle housing. The receptacle module includes a receptacle latch coupled to the receptacle housing. The receptacle latch includes a release actuator, a first latch arm extending from the release actuator and a second latch arm extending from the release actuator. The first release arm extends along the first side wall. The second release arm extends along the second side wall. The first release arm includes a first release tab configured to release the first latching beam from the first latching feature. The second release arm includes a second release tab configured to release the second latching beam from the second latching feature. The release actuator is actuated to slide the receptacle latch relative to the receptacle housing from an unactuated position to an actuated position to operate the first and second release tabs and unlatch the first and second latching beams from the first and second latching features. The receptacle module includes a latch alignment cap coupled to the receptacle housing. The receptacle latch is captured between the latch alignment cap and the receptacle housing. The receptacle latch is slidable relative to the receptacle housing and the latch alignment cap when pulled rearwardly from the unactuated position to the actuated position.

In another embodiment, a receptacle module is provided. The receptacle module is configured to be plugged into a receptacle cage of receptacle assembly for mating with a plug module plugged into the receptacle cage. The receptacle cage includes a first latching beam at a first side and a second latching beam at a second side of the receptacle cage. The receptacle module includes a receptacle housing having receptacle housing walls defining a receptacle module cavity. The receptacle housing walls include a top wall, a bottom wall a first side wall, and a second side wall. The first side wall includes a first latching feature configured to interface with the first latching beam of the receptacle cage to secure the receptacle module in the receptacle cage. The second side wall includes a second latching feature configured to interface with the second latching beam of the receptacle cage to secure the receptacle module in the receptacle cage. The receptacle housing has a card slot configured to receive a plug module circuit board of a plug module. The receptacle module includes a receptacle contact assembly received in the receptacle housing. The receptacle contact assembly includes receptacle contacts arranged in the receptacle housing at the card slot to interface with the plug module circuit board. The receptacle contact assembly includes cables terminated to the contacts and extending from the receptacle housing. The receptacle module includes a receptacle latch coupled to the receptacle housing. The receptacle latch includes a release actuator, a first latch arm extending from the release actuator and a second latch arm extending from the release actuator. The first release arm extends along the first side wall. The second release arm extends along the second side wall. The first release arm includes a first release tab configured to release the first latching beam from the first latching feature. The second release arm includes a second release tab configured to release the second latching beam from the second latching feature. The release actuator is actuated to slide the receptacle latch relative to the receptacle housing from an unactuated position to an actuated position to operate the first and second release tabs and unlatch the first and second latching beams from the first and second latching features. The receptacle module includes a latch alignment cap coupled to the receptacle housing. The receptacle latch is captured between the latch alignment cap and the receptacle housing. The receptacle latch is slidable relative to the receptacle housing and the latch alignment cap when pulled rearwardly from the unactuated position to the actuated position.

DETAILED DESCRIPTION OF THE INVENTION

Figure 1:
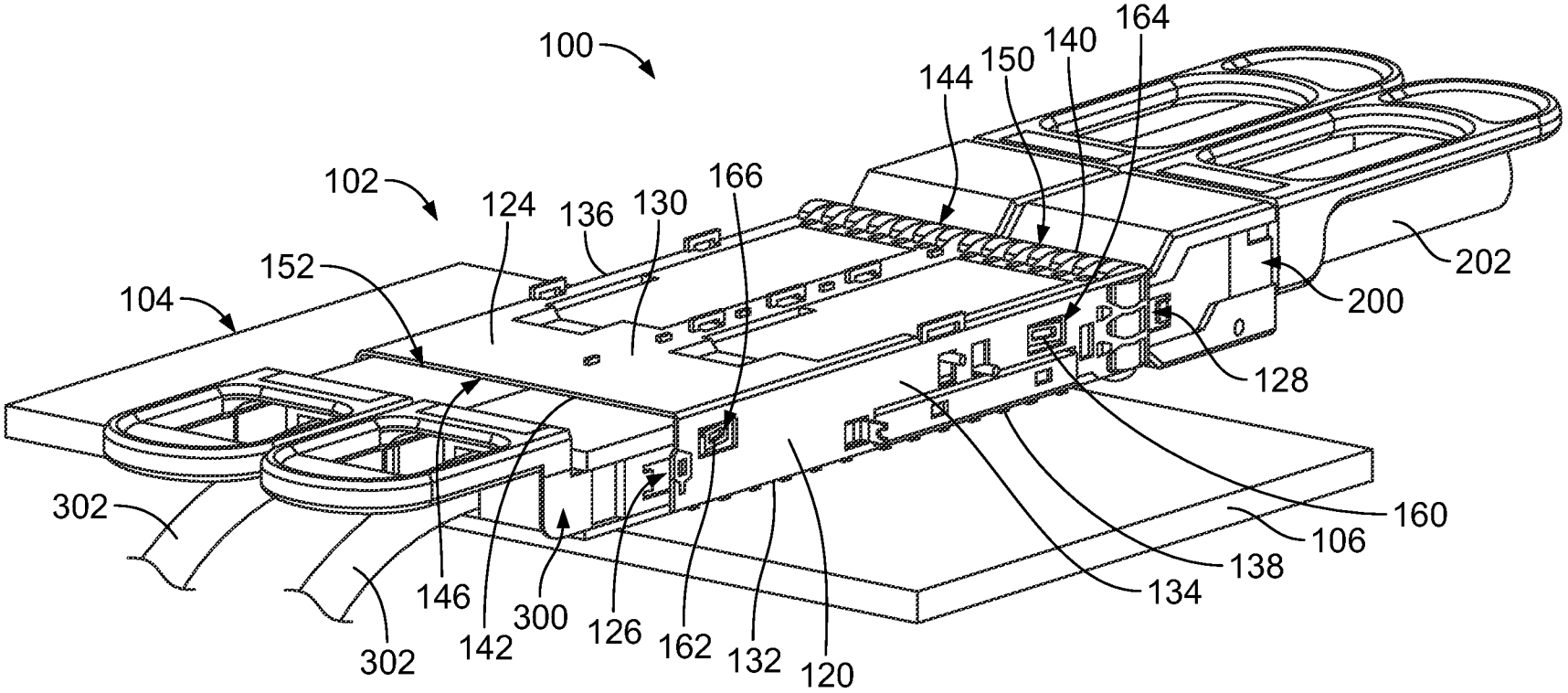
FIG. 1 is a top perspective view of a communication system formed in accordance with an exemplary embodiment.
Figure 2:
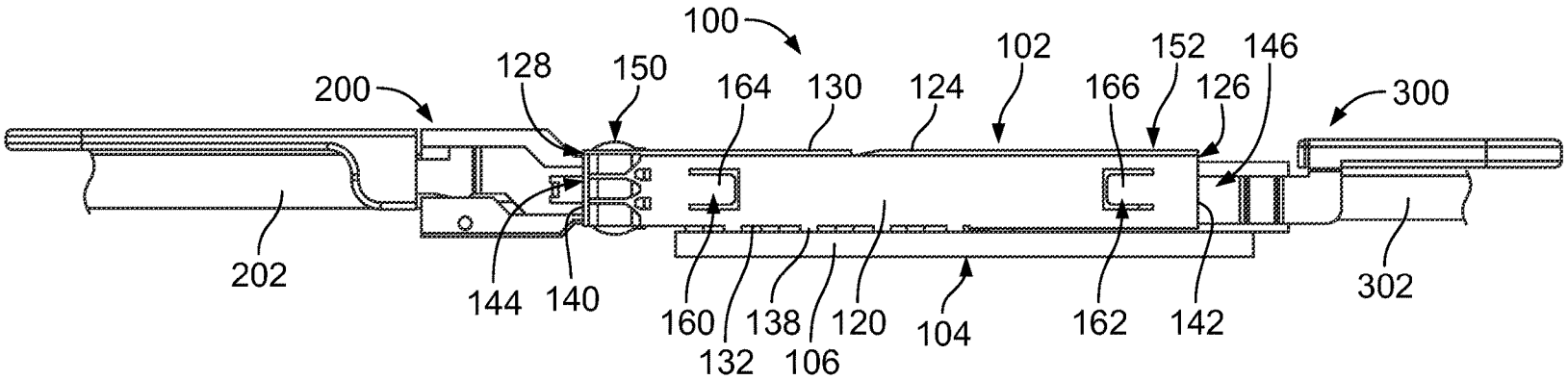
FIG. 2 is a side view of the communication system in accordance with an exemplary embodiment.

FIG. 1 is a top perspective view of a communication system 100 formed in accordance with an exemplary embodiment. FIG. 2 is a side view of the communication system 100 in accordance with an exemplary embodiment. The communication system 100 includes a receptacle connector assembly 102 and one or more plug modules 200 configured to be electrically connected to the receptacle connector assembly 102. The receptacle connector assembly 102 includes one or more receptacle modules 300 configured to be electrically connected to corresponding plug modules 200. In an exemplary embodiment, each plug module 200 is electrically connected to one or more cables 202 and each receptacle module 300 is electrically connected to one or more cables 302. The plug module 200 is pluggably coupled to the corresponding receptacle module 300 at a separable mating interface. The plug modules 200 and the receptacle modules 300 are removable from the shielding cage of the receptacle connector assembly 102.

In an exemplary embodiment, the receptacle connector assembly 102 is mounted to a support structure 104. For example, in the illustrated embodiment, the support structure 104 may include a circuit board 106. The receptacle connector assembly 102 is mounted to the circuit board 106. In an exemplary embodiment, neither the plug module 200 nor the receptacle module 300 is electrically connected to the circuit board 106. Rather, the plug module 200 and the receptacle module 300 are electrically connected to other electrical components via the cables 202, 302 rather than through traces on the circuit board 106. The circuit board 106 may provide a ground reference for the receptacle connector assembly 102. In an exemplary embodiment, the support structure 104 may additionally, or alternatively, include a panel, such as a rack panel in a server. In other various embodiments, the panel may include a cabinet or chassis of an electrical device, such as a computer. The panel may be another type of support structure in alternative embodiments, such as a metal plate or sheet.

In an exemplary embodiment, the receptacle connector assembly 102 includes a receptacle cage 120. The receptacle module 300 is configured to be loaded into a rear of the receptacle cage 120. The plug module 200 is configured to be loaded into a front of the receptacle cage 120. The plug module 200 is mated to the receptacle module 300 inside the receptacle cage 120. In various embodiments, the receptacle cage 120 is enclosed and provides electrical shielding for the receptacle module 300 and the plug module 200.

The receptacle cage 120 includes a plurality of cage walls 124 that define a cavity 126. The cavity 126 may be subdivided by corresponding cage walls 124 to form one or more module channels 128 for receipt of corresponding plug modules 200 and receptacle modules 300. In the illustrated embodiment, the cavity 126 is divided into two module channels 128, however, additional cage walls 124 may be provided to form additional module channels 128, such as four module channels 128 or more. The module channels 128 may be stacked vertically and/or horizontally. The receptacle cage 120 includes front ports open at the front of the receptacle cage 120 to receive the plug modules 200 and rear ports open at the rear of the receptacle cage 120 to receive the receptacle modules 300. Any number of module channels 128 may be provided in various embodiments. For example, the receptacle cage 120 may include both ganged and stacked module channels 128 (for example, 2×2, 3×2, 4×2, 4×3, etc.). In other various embodiments, rather than being a ganged or stacked cage member, the receptacle cage 120 may include a single module channel 128. The cage walls 124 may be walls defined by solid sheets, perforated walls to allow airflow therethrough, or walls with cutouts, such as for a heat transfer device such as a heatsink, heat spreader, cold plate, and the like to pass therethrough. In the illustrated embodiment, the cage walls 124 are stamped and formed walls defining shielding walls.

In an exemplary embodiment, the cage walls 124 of the receptacle cage 120 include a top cage wall 130, a bottom cage wall 132, a first side cage wall 134, and a second side cage wall 136 for each module channel 128. Such cage walls 124 may define a top wall, a bottom wall, a first side wall, and a second side wall of the receptacle cage 120 when such walls 130, 132, 134, 136 are the outer or exterior walls. The bottom cage wall 132 may rest on the support structure 104. In an exemplary embodiment, the cage walls 124 include cage mounting tabs 138 for mounting the receptacle cage 120 to the support structure 104, such as to the circuit board 106. For example, the cage mounting tabs 138 may be press-fit pins configured to be press-fit into vias in the circuit board 106. Other types of cage mounting tabs 138 may be used in alternative embodiments. However, in alternative embodiments, the receptacle cage 120 may stand alone separate from any circuit board, such as being mounted to a panel or other structure without any circuit board present.

The receptacle cage 120 extends between a front end 140 and a rear end 142. Front ports 144 are provided at the front end 140 providing access to the corresponding module channels 128 for the plug modules 200. Rear ports 146 are provided at the rear end 142 providing access to the corresponding module channels 128 for the receptacle modules 300. Some of the cage walls 124 may be interior cage walls that separate or divide the cavity 126 into the various module channels 128. For example, the cage walls 124 may include a divider separating the module channels 128 (for example, a horizontal divider or a vertical divider). The divider may define the top cage wall 130, the bottom cage wall 132, the first side cage wall 134, or the second side cage wall 136 of one or more of the module channels 128.

The walls 130, 132, 134, 136 form rectangular shaped module channels 128 in an exemplary embodiment extending along a longitudinal axis. The module channels 128 may extend the entire length between the front end 140 and the rear end 142. The receptacle cage 120 includes a front cage interface 150 at the front end 140 and a rear cage interface 152 at the rear end 142. The front cage interface 150 interfaces with the plug module 200. The rear cage interface 152 interfaces with the receptacle module 300. The front cage interface 150 is defined by an interior surface of the receptacle cage 120. The rear cage interface 152 is defined by an interior surface of the receptacle cage 120. In an exemplary embodiment, the front cage interface 150 is defined as the front quartile of the receptacle cage 120, including all features of the receptacle cage 120 interfacing with the plug module 200 and the rear cage interface 152 is defined as the rear quartile of the receptacle cage 120, including all features of the receptacle cage 120 interfacing with the receptacle module 300.

The front cage interface 150 is defined by the top cage wall 130, the bottom cage wall 132, the first side cage wall 134, and the second side cage wall 136 at the front end 140. For example, the front cage interface 150 may have a channel envelope (for example, size and shape) defined by the top cage wall 130, the bottom cage wall 132, the first side cage wall 134, and the second side cage wall 136 at the front end 140. The rear cage interface 152 is defined by the top cage wall 130, the bottom cage wall 132, the first side cage wall 134, and the second side cage wall 136 at the rear end 142. For example, the rear cage interface 152 may have a channel envelope (for example, size and shape) defined by the top cage wall 130, the bottom cage wall 132, the first side cage wall 134, and the second side cage wall 136 at the rear end 142. In an exemplary embodiment, the front cage interface 150 matches the rear cage interface 152. For example, the front cage interface 150 is identical to the rear cage interface 152. The front cage interface 150 may have the same size and the same shape as the rear cage interface 152. As such, either the plug module 200 or the receptacle module 300 may be plugged into and interface with the front cage interface 150 and such that either the plug module 200 or the receptacle module 300 may be plugged into and interface with the rear cage interface 152.

In an exemplary embodiment, the receptacle cage 120 includes front latching features 160 for each module channel 128 and rear latching features 162 for each module channel 128. The front latching features 160 are provided proximate to the front end 140. The rear latching features 162 are provided proximate to the rear end 142. The front latching features 160 form part of the front cage interface 150 configured to interface with the plug module 200. The rear latching features 162 form part of the rear cage interface 152 configured to interface with the receptacle module 300. The front latching features 160 are used to secure the plug module 200 in the module channel 128. The front latching features 160 are accessible and engaged by the plug module 200 from inside the module channel 128. The rear latching features 162 are used to secure the receptacle module 300 in the module channel 128. The rear latching features 162 are accessible and engaged by the receptacle module 300 from inside the module channel 128. The front latching features 160 may be identical to the rear latching feature 162.

In various embodiments, the latching features 160, 162 are deflectable latching tabs 164, 166 stamped from the side cage walls 134, 136. Edges of the latching tabs 164, 166 are latchably coupled to the plug module 200 and the receptacle module 300, respectively, to secure the modules 200, 300 in the module channel 128. The deflectable latching tabs 164, 166 are bent inward into the module channel 128 to engage sides of the plug module 200 and the receptacle module 300, respectively. The latching features 160, 162 may be released, such as by pulling on release tabs of the modules 200, 300 to release the latching tabs 164, 166 from the modules 200, 300. The deflectable latching tabs 164 extend rearwardly from the side cage walls 134, 136 to distal edges configured to engage the plug module 200 to retain the plug module 200 in the module channel 128 and resist pull out of the plug module 200 from the front end 140. The deflectable latching tabs 166 extend forwardly from the side cage walls 134, 136 to distal edges configured to engage the receptacle module 300 to retain the receptacle module 300 in the module channel 128 and resist pull out of the receptacle module 300 from the rear end 142.

Figure 3:
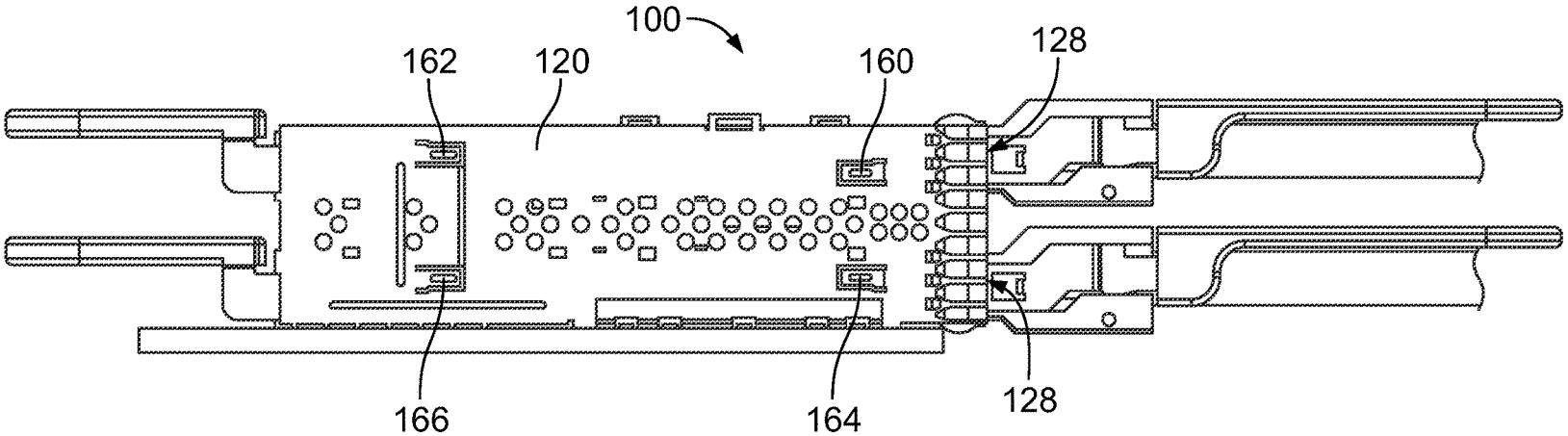
FIG. 3 is a side view of the communication system in accordance with an exemplary embodiment.

FIG. 3 is a side view of the communication system 100 in accordance with an exemplary embodiment. The receptacle cage 120 is a stacked receptacle cage having stacked module channels 128, such as defining an upper module channel and a lower module channel. The receptacle cage 120 includes latching features 160, 162 (for example, deflectable latching tabs 164, 166) for the upper and lower module channels 128.

Figure 4:
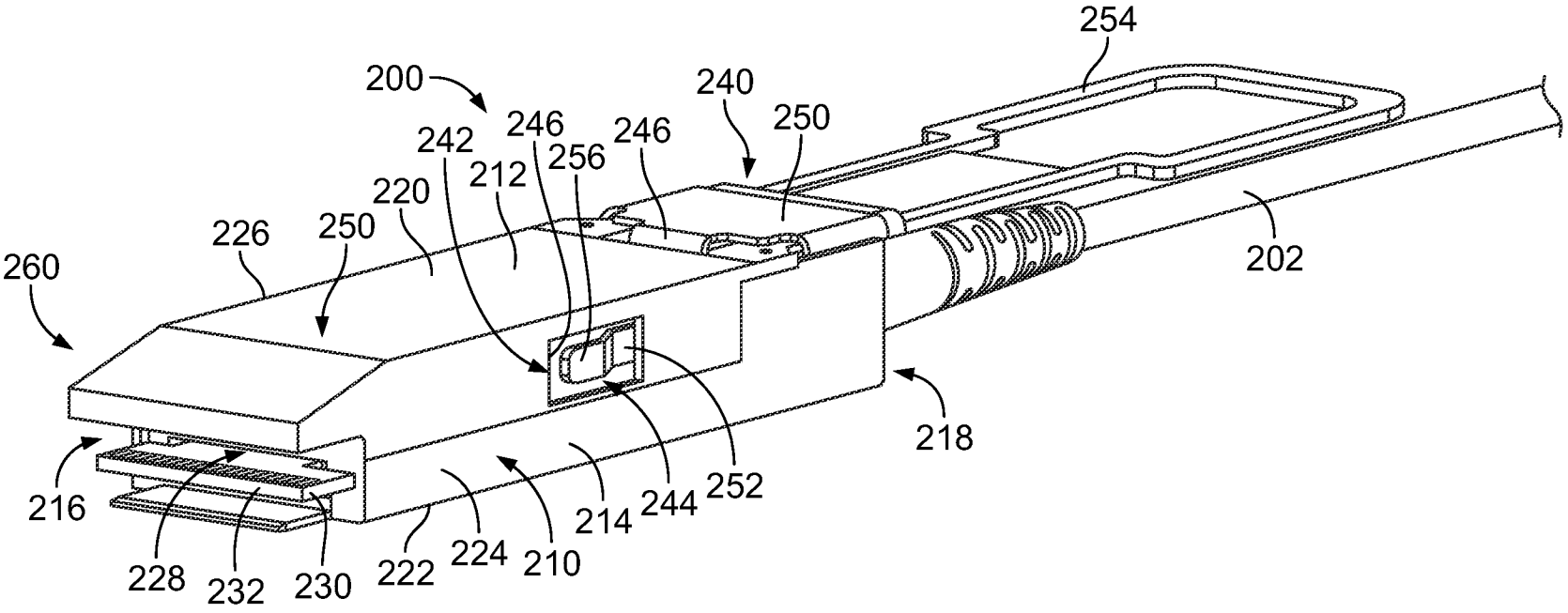
FIG. 4 is a perspective view of the plug module in accordance with an exemplary embodiment.

FIG. 4 is a perspective view of the plug module 200 in accordance with an exemplary embodiment. The plug module 200 includes a plug housing 210 defined by one or more shells, such as an upper shell 212 and a lower shell 214. In an exemplary embodiment, the plug housing 210 is manufactured from a conductive material, such as a metal material. The plug housing 210 provides electrical shielding for the plug module 200. The plug housing 210 may be thermally conductive. The plug housing 210 includes a mating end 216 and an opposite cable end 218. The cable 202 extends from the cable end 218. The mating end 216 is configured to be inserted into the corresponding module channel 128 (shown in FIG. 1). The cable end 218 is configured to extend from the front end 140 of the receptacle cage 120 (shown in FIG. 1) when the plug module 200 is plugged into the receptacle cage 120.

The plug housing 210 includes a top wall 220, a bottom wall 222, a first side wall 224 extending between the top wall 220 and the bottom wall 222, and a second side wall 226 extending between the top wall 220 and the bottom wall 222. The top wall 220 is part of the upper shell 212 and the bottom wall 222 is part of the lower shell 214. The first side wall 224 may be defined by the upper shell 212 and/or the lower shell 214. The second side wall 226 may be defined by the upper shell 212 and/or the lower shell 214. For example, in an exemplary embodiment, the upper and lower shells 212, 214 meet at an interface approximate centered along the side walls 224, 226. The plug housing 210 surrounds a plug module cavity 228. The plug module cavity 228 houses electrical components of the plug module 200. The cables 202 may extend into the plug module cavity 228 for termination to the electrical components.

In an exemplary embodiment, the plug module 200 includes a plug module circuit board 230 in the plug module cavity 228. The plug module circuit board 230 may be accessible at the mating end 216. The plug module circuit board 230 is configured to be communicatively coupled to the receptacle module 300 (shown in FIG. 1). For example, a mating edge 232 of the plug module circuit board 230 may be plugged into the receptacle module 300, such as in a card slot of the receptacle module 300. The plug module circuit board 230 includes electrical components used for operating and/or using the plug module 200. For example, the plug module circuit board 230 may have conductors, traces, pads, electronics, sensors, controllers, switches, inputs, outputs, and the like to form various circuits.

The plug module 200 includes a plug latch 240 for releasing the plug module 200 from the receptacle cage 120. The plug latch 240 includes plug latching features 242 at the first and second sides 224, 226 configured to secure the plug module 200 to the receptacle cage 120. For example, the plug latching features 242 are configured to interface with the front latching features 160 (shown in FIG. 1) of the receptacle cage 120. In an exemplary embodiment, the plug latching feature 242 includes a latching pocket 244. The deflectable latching tab 164 (shown in FIG. 1) is received in the latching pocket 244. In an exemplary embodiment, the plug housing 210 includes a latching shoulder 246 at the latching pocket 244. The deflectable latching tab 164 is received in the latching pocket 244 and engages the latching shoulder 246 to secure the plug module 200 in the receptacle cage 120.

In an exemplary embodiment, the plug latch 240 includes a plug release actuator 250 and latch arms 252 extending from the plug release actuator 250 along the first and second sides walls 224, 226. In an exemplary embodiment, the plug release actuator 250 includes a pull tab 254. The pull tab 254 is configured to be pulled to unlatch the deflectable latching tabs 164 to release the plug module 200 from the receptacle cage 120. For example, the pull tab 254 is pulled to move the plug latch 240 from an unactuated position to an actuated position. The latch arms 252 may slide horizontally relative to the plug housing 210 between the unactuated and actuated positions. The plug latch 240 may include a return spring (not shown) used to return the plug latch 240 to the unactuated position. The plug latch 240 includes plug release tabs 256 at distal ends of the latch arms 252. The plug release tabs 256 engage the deflectable latching tabs 164 when the plug latch 240 is moved from an unactuated position to an actuated position. The plug release tabs 256 press outward against the deflectable latching tabs 164 to release the deflectable latching tabs 164.

The plug housing 210 includes a plug mating interface 260 configured to interface with the front cage interface 150 (shown in FIG. 1) of the receptacle cage 120. The plug mating interface 260 is defined by an exterior surface of the plug housing 210. In an exemplary embodiment, the plug mating interface 260 is defined by the top wall 220, the bottom wall 222, the first side wall 224, and the second side wall 226, such as at the mating end 216. The plug mating interface 260 is defined by the plug latch 240, such as the latch arms 252 and the plug release tabs 256. The plug mating interface 260 may be defined along the entire length of the plug housing 210 that is received in the receptacle cage 120. For example, the plug mating interface 260 may extend a majority of the length of the plug housing 210.

Figure 5:
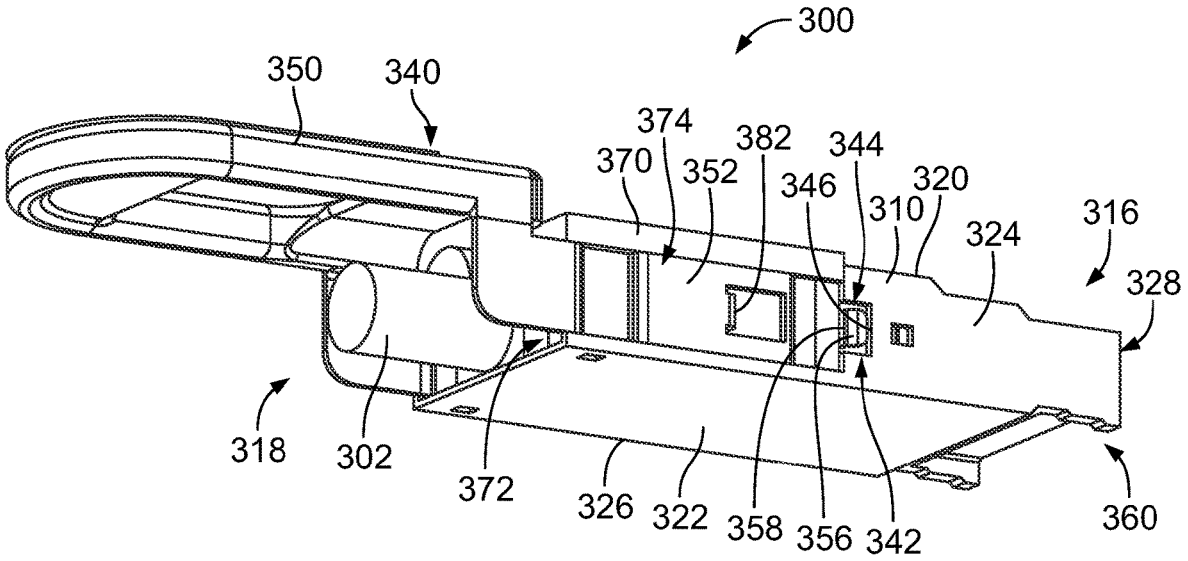
FIG. 5 is a perspective view of the receptacle module in accordance with an exemplary embodiment.
Figure 6:
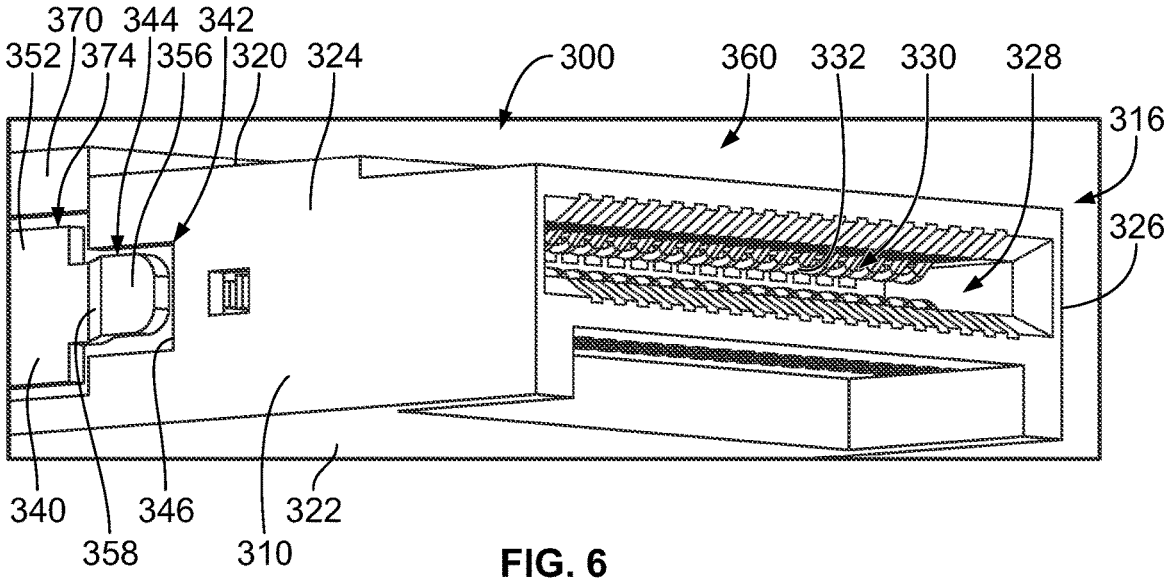
FIG. 6 is a front perspective view of a portion of the receptacle module in accordance with an exemplary embodiment.
Figure 7:
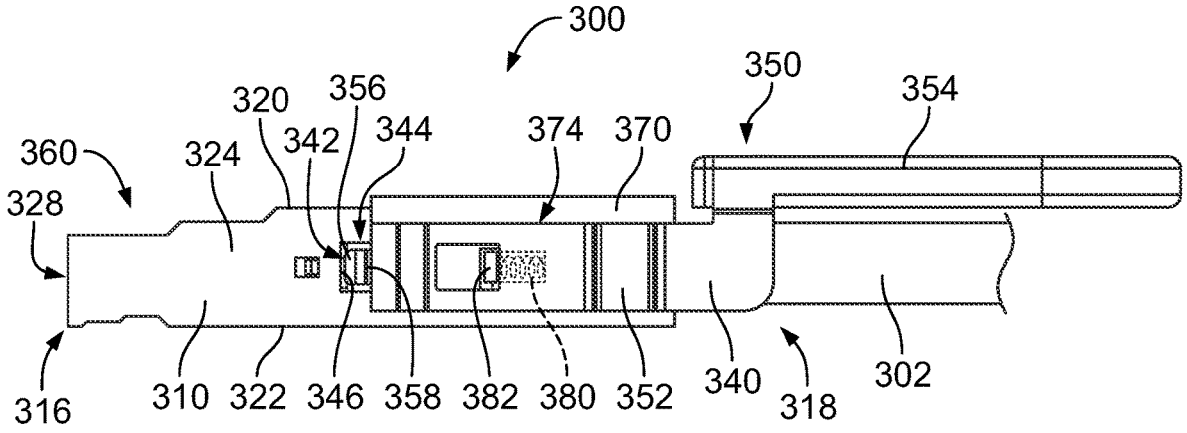
FIG. 7 is a side view of the receptacle module in accordance with an exemplary embodiment.

FIG. 5 is a perspective view of the receptacle module 300 in accordance with an exemplary embodiment. FIG. 6 is a front perspective view of a portion of the receptacle module 300 in accordance with an exemplary embodiment. FIG. 7 is a side view of the receptacle module 300 in accordance with an exemplary embodiment.

The receptacle module 300 includes a receptacle housing 310 defined by one or more shells, such as an upper shell and a lower shell. Optionally, the receptacle housing 310 may be at least partially manufactured from a conductive material, such as a metal material to provide electrical shielding for the receptacle module 300. The receptacle housing 310 includes a mating end 316 and an opposite cable end 318. The cable 302 extends from the cable end 318. The mating end 316 is configured to be inserted into the corresponding module channel 128 (shown in FIG. 1). The cable end 318 is configured to extend from the rear end 142 of the receptacle cage 120 (shown in FIG. 1) when the receptacle module 300 is plugged into the receptacle cage 120.

The receptacle housing 310 includes a top wall 320, a bottom wall 322, a first side wall 324 extending between the top wall 320 and the bottom wall 322, and a second side wall 326 extending between the top wall 320 and the bottom wall 322. In an exemplary embodiment, the receptacle housing 310 includes a card slot 328 at the mating end 316. The card slot 328 is configured to receive the plug module circuit board 230 (shown in FIG. 4). The receptacle housing 310 extends above and below the card slot 328.

In an exemplary embodiment, the receptacle module 300 includes a receptacle contact assembly 330 (FIG. 6) received in the receptacle housing 310. The receptacle contact assembly 330 includes receptacle contacts 332. Conductors of the cables 302 may be terminated to the receptacle contacts 332, such as being soldered to the contacts 332. The receptacle contacts 332 extend to the card slot 328 for mating with the plug module circuit board 230. In the illustrated embodiment, the receptacle contacts 332 are arranged in an upper row and a lower row on opposite sides of the card slot 328.

The receptacle module 300 includes a receptacle latch 340 for releasing the receptacle module 300 from the receptacle cage 120. The receptacle latch 340 includes receptacle latching features 342 at the first and second sides 324, 326 configured to secure the receptacle module 300 to the receptacle cage 120. For example, the receptacle latching features 342 are configured to interface with the rear latching features 162 (shown in FIG. 1) of the receptacle cage 120. In an exemplary embodiment, the receptacle latching feature 342 includes a latching pocket 344. The deflectable latching tab 166 (shown in FIG. 1) is received in the latching pocket 344. In an exemplary embodiment, the receptacle housing 310 includes a latching shoulder 346 at the latching pocket 344. The deflectable latching tab 166 is received in the latching pocket 344 and engages the latching shoulder 346 to secure the receptacle module 300 in the receptacle cage 120.

In an exemplary embodiment, the receptacle latch 340 includes a receptacle release actuator 350 and latch arms 352 extending from the receptacle release actuator 350 along the first and second sides walls 324, 326. In an exemplary embodiment, the receptacle release actuator 350 includes a pull tab 354. The pull tab 354 is configured to be pulled to unlatch the deflectable latching tabs 166 to release the receptacle module 300 from the receptacle cage 120. For example, the pull tab 354 is pulled to move the receptacle latch 340 from an unactuated position to an actuated position. The latch arms 352 may slide horizontally relative to the receptacle housing 310 between the unactuated and actuated positions.

The receptacle latch 340 includes receptacle release tabs 356 at distal ends of the latch arms 352. The receptacle release tabs 356 engage the deflectable latching tabs 164 when the receptacle latch 340 is moved from an unactuated position to an actuated position. The receptacle release tabs 356 press outward against the deflectable latching tabs 164 to release the deflectable latching tabs 164. Each receptacle release tab 356 includes a ramp 358. The ramp 358 is angled outward from the receptacle housing 310. The ramp 358 extends at an angle that is non-perpendicular to the side walls 324, 326. The ramp 358 may be curved. When the receptacle latch 340 is pulled to the actuated position, deflectable latching tab 166 slides along the ramp 358 and is deflected outward by the ramp 358 and is unlatched from the latching shoulder 346. In an exemplary embodiment, the receptacle latch 340 is movable between the actuated position and the unactuated position by pulling on the receptacle release actuator 350 to slide the receptacle release tabs 356 relative to the receptacle housing 310. The receptacle release tabs 356 engage the deflectable rear latching tabs 164 to release the deflectable rear latching tabs 164 from the receptacle module 300 in the actuated position.

The receptacle module 300 includes a latch alignment cap 370 coupled to the receptacle housing 310. The receptacle latch 340 may be coupled to the latch alignment cap 370 and/or the receptacle housing 310. The latch alignment cap 370 may be provided at the top wall 320 and/or the side walls 324, 326 and/or the bottom wall 322. The latch alignment cap 370 may be received in a cavity 372 of the receptacle housing 310, such as at the cable end 318. The receptacle latch 340 is captured between the latch alignment cap 370 and the receptacle housing 310. The receptacle latch 340 is slidable relative to the receptacle housing 310 and the latch alignment cap 370 when the receptacle latch 340 is pulled rearwardly from the unactuated position to the actuated position. In an exemplary embodiment, the receptacle module 300 includes tracks 374 along the side walls 324, 326. The tracks 374 receive the latch arms 352. The latch arms 352 are slidable in the tracks 374. In an exemplary embodiment, the tracks 374 are defined between the latch alignment cap 370 and the bottom wall 322 of the receptacle housing 310.

In an exemplary embodiment, the latch alignment cap 370 holds a return spring 380 operably coupled to the receptacle latch 340. The return spring 380 urges the receptacle latch 340 to return to the unactuated position from the actuated position. For example, the return spring 380 presses the receptacle latch 340 rearward. In an exemplary embodiment, the receptacle latch 340 includes a locating tab 382 extending from the latch arm 352. For example, the locating tab 382 may be stamped from the latch arm 352 and bent inward. The locating tab 382 extends into the latch alignment cap 370. The return spring 380 engages the locating tab 382 to press against the receptacle latch 340. The return spring 380 may be a coil spring. The return spring 380 is compressible between the locating tab 382 and the latch alignment cap 370.

The receptacle housing 310 includes a receptacle mating interface 360 configured to interface with the front cage interface 150 (shown in FIG. 1) of the receptacle cage 120. The receptacle mating interface 360 is defined by an exterior surface of the receptacle housing 310. In an exemplary embodiment, the receptacle mating interface 360 is defined by the top wall 320, the bottom wall 322, the first side wall 324, and the second side wall 326, such as at the mating end 316. The receptacle mating interface 360 is defined by the receptacle latch 340, such as the latch arms 352 and the receptacle release tabs 356. The receptacle mating interface 360 may be defined along the entire length of the receptacle housing 310 that is received in the receptacle cage 120. For example, the receptacle mating interface 360 may extend a majority of the length of the receptacle housing 310.

With additional reference back to FIG. 4, in an exemplary embodiment, the receptacle mating interface 360 (for interfacing with the receptacle cage 120) matches the plug mating interface 260 (for interfacing with the receptacle cage 120). For example, the receptacle mating interface 360 may have generally the same size and shape (width and height) as the plug mating interface 260, particularly at the latches 240, 340. For example, at the depth of the latches 240, 340, the plug housing 210 and the receptacle housing 310 may have generally the same exterior perimeter dimensions. Other portions of the plug housing 210 and the receptacle housing 310 may have different dimensions, such as the ends of the plug module 200 and the receptacle module 300 that are located exterior of the receptacle cage 120. In an exemplary embodiment, the mating interfaces 260, 360 are identical such that the plug module 200 and the receptacle module 300 may be interchangeably received in the receptacle cage 120. The plug latch 240 and the receptacle latch 340 define portions of the mating interfaces 260, 360, respectively.

Figure 8:
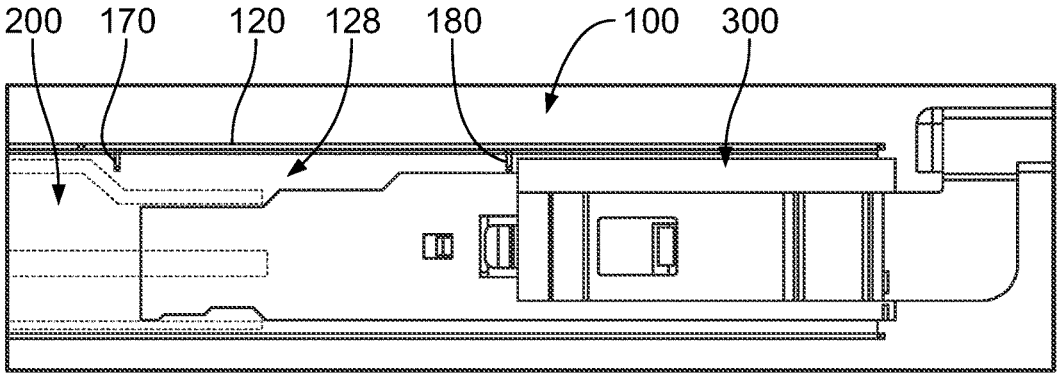
FIG. 8 is a side, partial sectional view of a portion of the communication system in accordance with an exemplary embodiment.

FIG. 8 is a side, partial sectional view of a portion of the communication system 100 in accordance with an exemplary embodiment. FIG. 8 shows the receptacle module 300 loaded into the receptacle cage 120. In an exemplary embodiment, the receptacle cage 120 includes a front locating tab 170 extending into the module channel 128. The front locating tab 170 is used to locate the pluggable module 200 in the module channel 128. For example, the front locating tab 170 stops the pluggable module 200 and prevents the pluggable module 200 from overloading into the module channel 128.

In an exemplary embodiment, the receptacle cage 120 includes a rear locating tab 180 extending into the module channel 128. The rear locating tab 180 is used to locate the receptacle module 300 in the module channel 128. For example, the rear locating tab 180 stops the receptacle module 300 and prevents the receptacle module 300 from overloading into the module channel 128.

It is to be understood that the above description is intended to be illustrative, and not restrictive. For example, the above-described embodiments (and/or aspects thereof) may be used in combination with each other. In addition, many modifications may be made to adapt a particular situation or material to the teachings of the invention without departing from its scope. Dimensions, types of materials, orientations of the various components, and the number and positions of the various components described herein are intended to define parameters of certain embodiments, and are by no means limiting and are merely exemplary embodiments. Many other embodiments and modifications within the spirit and scope of the claims will be apparent to those of skill in the art upon reviewing the above description. The scope of the invention should, therefore, be determined with reference to the appended claims, along with the full scope of equivalents to which such claims are entitled. In the appended claims, the terms "including" and "in which" are used as the plain-English equivalents of the respective terms "comprising" and "wherein." Moreover, in the following claims, the terms "first," "second," and "third," etc. are used merely as labels, and are not intended to impose numerical requirements on their objects. Further, the limitations of the following claims are not written in means-plus-function format and are not intended to be interpreted based on 35 U.S.C. § 112(f), unless and until such claim limitations expressly use the phrase "means for" followed by a statement of function void of further structure.

What is claimed is:

1. A communication system comprising:

a plug module including a plug housing having plug housing walls defining a plug module cavity, the plug housing walls including a top wall, a bottom wall and sidewalls between the top wall and the bottom wall, the plug module including a plug latch coupled to the plug housing, the plug latch including plug latching features at the sidewalls of the plug housing and plug release tabs operably coupled to a plug release actuator, the plug module including a plug module circuit board held by the plug housing in the plug module cavity, the plug module circuit board having a mating edge, the plug module including cables terminated to the plug module circuit board;

a receptacle module including a receptacle housing having receptacle housing walls defining a receptacle module cavity, the receptacle housing walls including a top wall, a bottom wall and sidewalls between the top wall and the bottom wall, the receptacle module including a receptacle latch coupled to the receptacle housing, the receptacle latch including receptacle latching features at the sidewalls of the receptacle housing and receptacle release tabs operably coupled to a receptacle release actuator, the receptacle module including a receptacle contact assembly received in the receptacle housing, the receptacle contact assembly including receptacle contacts, the receptacle housing having a card slot at a front of the receptacle housing receiving the mating edge of the plug module circuit board to electrically connect the receptacle contacts to the plug module circuit board, the receptacle module including cables terminated to the receptacle contacts and extending rearward from the receptacle housing; and a receptacle cage having cage walls defining a module channel, the module channel extending between a front end and a rear end of the receptacle cage, the cage walls including a top cage wall, a bottom cage wall, and side cage walls extending between the top cage wall and the bottom cage wall, the receptacle cage having a front cage interface receiving the plug module at the front end and the receptacle cage having a rear cage interface receiving the receptacle module at the rear end, the receptacle cage including front latching features at the side cage walls interfacing with the plug latching features for latchably securing the plug module in the receptacle cage, the receptacle cage including rear latching features at the side cage walls interfacing with the receptacle latching features for latchably securing the receptacle module in the receptacle cage, wherein the front latching features include deflectable front latching tabs extending into the module channel from the side cage walls to interface with the plug module, and wherein the rear latching features includes deflectable rear latching tabs extending into the module channel from the side cage walls to interface with the receptacle module.

2. The communication system of claim 1, wherein the deflectable front latching tabs extend rearwardly from the side cage walls to distal edges configured to engage the plug module to retain the plug module in the module channel and resist pull out of the plug module from the front end, and wherein the deflectable rear latching tabs extend forwardly from the side cage walls to distal edges configured to engage the receptacle module to retain the receptacle module in the module channel and resist pull out of the plug module from the rear end.

3. The communication system of claim 1, wherein the plug latch is movable between an actuated position and an unactuated position by pulling on the plug release actuator to slide the plug release tabs relative to the plug housing, the plug release tabs engaging the deflectable front latching tabs to release the deflectable front latching tabs from the plug module in the actuated position, and wherein the receptacle latch is movable between an actuated position and an unactuated position by pulling on the receptacle release actuator to slide the receptacle release tabs relative to the receptacle housing, the receptacle release tabs engaging the deflectable rear latching tabs to release the deflectable rear latching tabs from the receptacle module in the actuated position.

4. The communication system of claim 1, wherein the receptacle module includes a latch alignment cap coupled to the receptacle housing, the receptacle latch being captured between the latch alignment cap and the receptacle housing, the receptacle latch being slidable relative to the receptacle housing and the latch alignment cap when pulled rearwardly from an unactuated position to an actuated position, the receptacle latch unlatching the rear latching features from the receptacle module in the actuated position.

5. The communication system of claim 4, wherein the latch alignment cap holds a return spring operably coupled to the receptacle latch urging the receptacle latch to return to the unactuated position from the actuated position.

6. The communication system of claim 5, wherein the receptacle latch includes a locating tab extending into the latch alignment cap, the return spring engaging the locating tab to press against the receptacle latch.

7. The communication system of claim 1, wherein the front cage interface matches the rear cage interface.

8. The communication system of claim 1, wherein the front cage interface is defined by the top cage wall, the bottom cage wall and the side cage walls of the receptacle cage, the front cage interface having a front port at the front end open to the module channel, the front cage interface including the front latching features, and wherein the rear cage interface is defined by the top cage wall, the bottom cage wall and the side cage walls of the receptacle cage, the rear cage interface having a rear port at the rear end open to the module channel, the rear cage interface including the rear latching features.

9. The communication system of claim 8, wherein a size and a shape of the front cage interface is identical to a size and a shape of the rear cage interface.

10. The communication system of claim 1, wherein the receptacle housing includes a receptacle mating interface defined by the top wall, the bottom wall, and the sidewalls of the receptacle housing, and wherein the plug housing includes a plug mating interface defined by the top wall, the bottom wall, and the sidewalls of the plug housing, the receptacle mating interface matching the plug mating interface, wherein a size and a shape of the receptacle mating interface is identical to a size and a shape of the plug mating interface.

11. The communication system of claim 1, wherein the plug latching features interface with the front latching features of the receptacle cage from inside the receptacle cage to secure the plug housing in the receptacle cage and wherein the receptacle latching features interface with the rear latching features of the receptacle cage from inside the receptacle cage to secure the receptacle housing in the receptacle cage.

12. The communication system of claim 1, wherein the module channel has a channel envelope defined by the top cage wall, the bottom cage wall, and the side cage walls, the plug module housing and the receptacle module housing fitting within the channel envelope.

13. The communication system of claim 1, wherein the receptacle cage further comprises a second module channel configured to receive a second plug module and a second receptacle module, the module channel and the second module channel being stacked vertically.

14. The communication system of claim 1, wherein the receptacle cage further comprises a second module channel configured to receive a second plug module and a second receptacle module, the module channel and the second module channel being stacked horizontally being separated by only a single piece of sheet metal.

15. A communication system comprising:

a receptacle cage having cage walls defining a module channel, the module channel extending between a front end and a rear end of the receptacle cage, the cage walls including a top cage wall, a bottom cage wall, a first side cage wall and a second side cage wall, the cage walls enclosing the module channel between the front end and the rear end, the receptacle cage configured to receive a plug module at the front end, the receptacle cage including a first latching beam at a first side and a second latching beam at a second side of the receptacle cage; and a receptacle module removably received in the module channel at the rear end, the receptacle module comprising:

a receptacle housing having receptacle housing walls defining a receptacle module cavity, the receptacle housing walls including a top wall, a bottom wall a first side wall, and a second side wall, the first side wall including a first latching feature configured to interface with the first latching beam of the receptacle cage to secure the receptacle module in the receptacle cage, the second side wall including a second latching feature configured to interface with the second latching beam of the receptacle cage to secure the receptacle module in the receptacle cage, the receptacle housing having a card slot configured to receive a plug module circuit board of the plug module;

a receptacle contact assembly received in the receptacle housing, the receptacle contact assembly including receptacle contacts arranged in the receptacle housing at the card slot to interface with the plug module circuit board, the receptacle contact assembly including cables terminated to the contacts and extending from the receptacle housing;

a receptacle latch coupled to the receptacle housing, the receptacle latch including a release actuator, a first latch arm extending from the release actuator and a second latch arm extending from the release actuator, the first release arm extending along the first side wall, the second release arm extending along the second side wall, the first release arm including a first release tab configured to release the first latching beam from the first latching feature, the second release arm including a second release tab configured to release the second latching beam from the second latching feature, the release actuator being actuated to slide the receptacle latch relative to the receptacle housing from an unactuated position to an actuated position to operate the first and second release tabs and unlatch the first and second latching beams from the first and second latching features; and a latch alignment cap coupled to the receptacle housing, the receptacle latch being captured between the latch alignment cap and the receptacle housing, the receptacle latch being slidable relative to the receptacle housing and the latch alignment cap when pulled rearwardly from the unactuated position to the actuated position.

16. The communication system of claim 15, wherein the latch alignment cap holds a return spring operably coupled to the receptacle latch urging the receptacle latch to return to the unactuated position from the actuated position.

17. The communication system of claim 16, wherein the receptacle latch includes a locating tab extending into the latch alignment cap, the return spring engaging the locating tab to press against the receptacle latch.

18. A receptacle module configured to be plugged into a receptacle cage of receptacle assembly for mating with a plug module plugged into the receptacle cage, the receptacle cage including a first latching beam at a first side and a second latching beam at a second side of the receptacle cage, the receptacle module comprising:

a receptacle housing having receptacle housing walls defining a receptacle module cavity, the receptacle housing walls including a top wall, a bottom wall a first side wall, and a second side wall, the first side wall including a first latching feature configured to interface with the first latching beam of the receptacle cage to secure the receptacle module in the receptacle cage, the second side wall including a second latching feature configured to interface with the second latching beam of the receptacle cage to secure the receptacle module in the receptacle cage, the receptacle housing having a card slot configured to receive a plug module circuit board of a plug module;

a receptacle contact assembly received in the receptacle housing, the receptacle contact assembly including receptacle contacts arranged in the receptacle housing at the card slot to interface with the plug module circuit board, the receptacle contact assembly including cables terminated to the contacts and extending from the receptacle housing;

a receptacle latch coupled to the receptacle housing, the receptacle latch including a release actuator, a first latch arm extending from the release actuator and a second latch arm extending from the release actuator, the first release arm extending along the first side wall, the second release arm extending along the second side wall, the first release arm including a first release tab configured to release the first latching beam from the first latching feature, the second release arm including a second release tab configured to release the second latching beam from the second latching feature, the release actuator being actuated to slide the receptacle latch relative to the receptacle housing from an unactuated position to an actuated position to operate the first and second release tabs and unlatch the first and second latching beams from the first and second latching features; and a latch alignment cap coupled to the receptacle housing, the receptacle latch being captured between the latch alignment cap and the receptacle housing, the receptacle latch being slidable relative to the receptacle housing and the latch alignment cap when pulled rearwardly from the unactuated position to the actuated position.

19. The receptacle module of claim 18, wherein the latch alignment cap holds a return spring operably coupled to the receptacle latch urging the receptacle latch to return to the unactuated position from the actuated position.

20. The communication system of claim 19, wherein the receptacle latch includes a locating tab extending into the latch alignment cap, the return spring engaging the locating tab to press against the receptacle latch.

* * * * *